United States Patent [19]

Yamamoto et al.

[11] 4,246,047

[45] Jan. 20, 1981

[54] NON-MAGNETIC STAINLESS STEEL

[75] Inventors: Susumu Yamamoto; Kazuyoshi Sato, both of Itami, Japan

[73] Assignee: Sumitomo Electric Industries, Ltd., Osaka, Japan

[21] Appl. No.: 971,836

[22] Filed: Dec. 19, 1978

[30] Foreign Application Priority Data

Dec. 27, 1977 [JP] Japan ..... 52-156565

[51] Int. Cl.[3] ..... C22C 39/54

[52] U.S. Cl. ..... 148/38; 75/125; 75/128 N; 75/128 W

[58] Field of Search ..... 75/128 N, 128 W, 125; 148/38

[56] References Cited

U.S. PATENT DOCUMENTS

| | | | |
|---|---|---|---|
| 1,990,590 | 2/1935 | Franks | 75/128 N |
| 2,229,065 | 1/1941 | Franks | 75/128 N |
| 2,471,080 | 5/1949 | Post | 75/128 N |
| 2,553,707 | 5/1951 | Goller | 148/38 |
| 2,602,737 | 7/1952 | Binder et al. | 75/128 N |
| 3,306,736 | 2/1967 | Rundell | 75/128 N |
| 3,551,142 | 12/1970 | Decroix | 75/128 N |

FOREIGN PATENT DOCUMENTS

| | | | |
|---|---|---|---|
| 613900 | 2/1961 | Canada | 148/38 |
| 1483037 | 4/1969 | Fed. Rep. of Germany | 75/128 N |
| 764757 | 5/1934 | France | 75/128 N |
| 1070744 | 6/1967 | United Kingdom | 75/128 N |
| 1197526 | 7/1970 | United Kingdom | 148/38 |
| 1224898 | 3/1971 | United Kingdom | 75/128 N |

OTHER PUBLICATIONS

Haefner et al., "Property Relationships of Some Cast and Forged Cr-Mn-Ni-$N_2$ Steels Containing 18% Cr". 1959, ASTM, pp. 1-12.

*Primary Examiner*—M. J. Andrews

*Attorney, Agent, or Firm*—Wenderoth, Lind & Ponack

[57] ABSTRACT

This invention relates to a high strength non-magnetic stainless steel for a spring, which comprises at most 0.2% of carbon, at most 3% of manganese, at most 0.045% of phosphorus, at most 0.03% of sulfur, at most 1% of silicon, 18 to 20% of chromium, 8 to 12% of nickel, 0.08 to 0.25% of nitrogen and the balance of iron and which is subjected to a heat treatment and a cold or warm working.

2 Claims, 6 Drawing Figures

NON-MAGNETIC STAINLESS STEEL

BACKGROUND OF THE INVENTION

1. Field of the Invention

The present invention relates to a non-magnetic stainless steel and more particularly it is concerned with a low-priced and non-magnetic stainless steel for a spring, having excellent properties.

2. Description of the Prior Art

Up to the present time, SUS 304 stainless steel has widely been used as a high strength stainless steel for a spring. SUS 304 stainless steel is considered to be non-magnetic because of having an austenitic structure after a heat treatment, but SUS 304 obtained as a material for a spring is not non-magnetic because, when subjected to cold working to obtain a high strength as a spring, the austenite is partially transformed into a strain-induced martensite that is ferromagnetic. This strain-induced martensite acts also as a notch or a nucleus of fatigue fracture, resulting in deterioration of the fatigue property. In a case where a non-magnetic property is required, therefore, SUS 316 having a large nickel content has often been used. However, SUS 316 is too expensive because of containing large amounts of nickel and molybdenum and, in addition, SUS 316 is not so suitable for use as a spring steel because of containing large amounts of additional elements so that the strength is only 80 to 90% of that of SUS 304.

SUMMARY OF THE INVENTION

It is an object of the present invention to provide a non-magnetic steel having a high strength.

It is another object of the present invention to provide a cheap and non-magnetic stainless steel for a spring, which has various excellent mechanical properties.

It is a further object of the present invention to provide a non-magnetic spring steel which austenitic structure is stabilized by adding nitrogen.

The objects can be attained by a high strength non-magnetic stainless steel for a spring, which consists of 0.20% or less of carbon, 3.00% or less of manganese, 0.045% or less of phosphorus, 0.030% or less of sulfur, 1.00% or less of silicon, 18.00 to 20.00% of chromium, 8.00 to 12.00% of nickel, 0.08 to 0.25% of nitrogen and the balance of iron and which is subjected to a heat treatment and a cold or warm working.

BRIEF DESCRIPTION OF THE DRAWING

The accompanying drawings are to illustrate the principle and merits of the present invention in more detail.

DETAILED DESCRIPTION OF THE INVENTION

Figure 1:
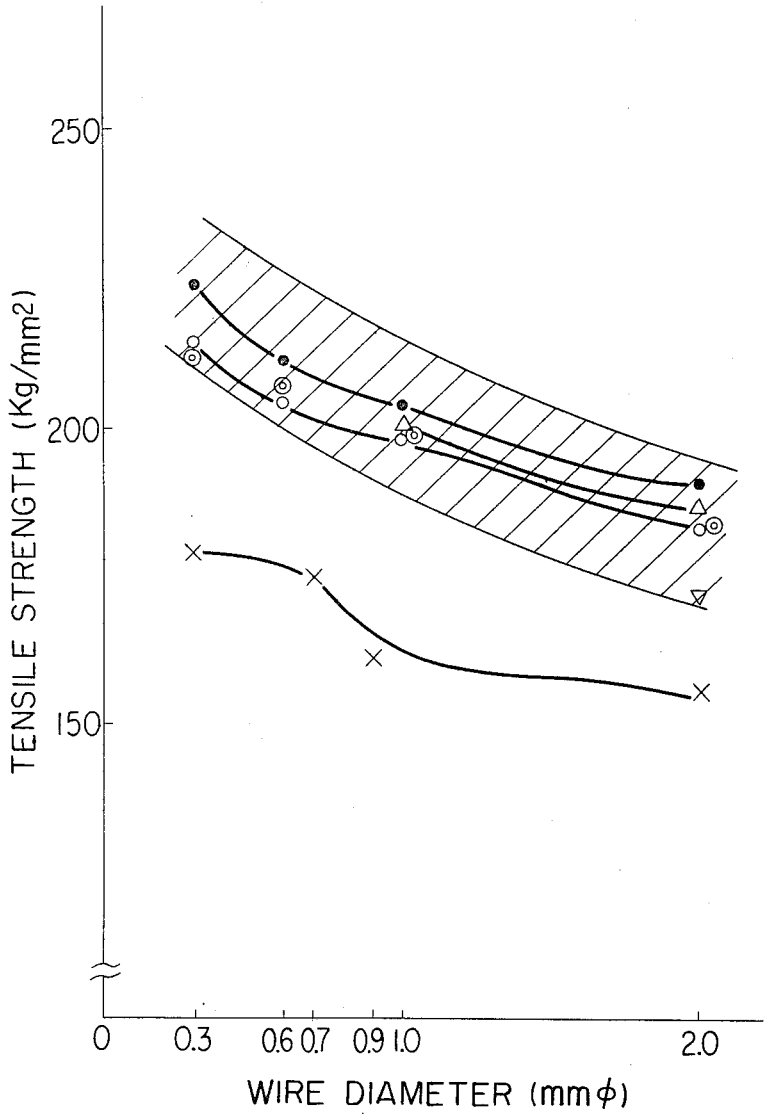
FIG. 1 shows graphically the relation of the wire diameter and tensile strength as to the stainless steels of the present invention and the prior art.

The inventors have made efforts to find a stainless steel for a spring, whereby the above described disadvantages of the prior art can be overcome, and consequently, have found that this object can be accomplished by adding nitrogen to the ordinary 18Cr-8Ni type stainless steel and then subjecting to melting, hot rolling, heat treatment, i.e. solution treatment and cold or warm working whereby to give a strength sufficient for a spring. The present invention is based on this finding.

Therefore, in accordance with the present invention, there is provided a high strength non-magnetic stainless steel suitable for a spring, which comprises 0.2% or less, generally 0.01 to 0.20% of carbon, 3.00% or less, generally 0.5 to 3.00% of manganese, 0.045% or less, generally 0.001 to 0.045% of phosphorus, 0.030% or less, generally 0.001 to 0.030% of sulfur, 1.00% or less, generally 0.1 to 1.00% of silicon, 18.00 to 20.00% of chromium, 8.00 to 12.00% nickel, 0.08 to 0.25% of nitrogen and the balance iron, and which is subjected to a heart treatment and a cold or warm working. The percents used in this specification are to be taken as those by weight unless otherwise indicated.

Nitrogen is added for the purpose of stabilizing the austenitic structure in a proportion of generally 0.08 to 0.25%, but the preferable range is 0.15 to 0.22%, since if less than 0.08%, the effect of non-magnetizing is little and if more than 0.25%, melting and hot rolling are difficult. In addition, the steel of the invention can contain 2% or less of molybdenum and 1% or less of copper. Manganese is effective for stabilizing the austenite and thus a martensite does not tend to occur with an increased amount of manganese. However, if more than 3%, there is a problem on the brick life during melting of the steel. In the stainless steel according to the present invention, the austenitic structure can be stabilized by adding nitrogen and the martensitic transformation due to cold or warm working can be suppressed to make the steel non-magnetic. Since this stainless steel has the similar components to SUS 304, rapid hardening takes place by cold working to give a high strength and crystal grains are made fine to raise the toughness. Furthermore, carbonitrides are formed to pin the dislocations and to improve the high temperature strength. The stainless steel of the present invention is also excellent in fatigue property due to its little martensite as well as in resistance to pitting corrosion due to its stabilized austenite by nitrogen resulting in suppression of formation of δ-ferrite.

The following examples, which are representative of some of the compositions of the present invention, describe in detail five specific compositions.

EXAMPLES

The specimens of the present invention (Sample A–E) and the prior art having the chemical compositions as shown in Table 1 were drawn and then subjected to measurement of various properties. The drawing was carried out by the ordinary cold drawing method, but in the case of Samples B and E only, the cooling means of a drawing machine was stopped to increase the drawing temperature and to effect the warm drawing thereof. The final wire diameters are shown in Table 2 and the temperatures of the last die at inlet and outlet are shown in Table 3, measured by means of a contact type thermometer.

TABLE 1

| | Chemical Composition of Specimens | | | | | | | | | |
|---|---|---|---|---|---|---|---|---|---|---|
| | C | Si | Mn | P | S | Cu | Cr | Ni | Mo | N |
| SUS 304 | 0.069 | 0.72 | 1.42 | 0.024 | 0.011 | 0.05 | 18.17 | 8.80 | 0.05 | 0.021 |
| Sample A | 0.073 | 0.66 | 1.44 | 0.032 | 0.012 | 0.21 | 18.28 | 8.50 | 0.24 | 0.15 |
| Sample B | 0.073 | 0.66 | 1.44 | 0.032 | 0.012 | 0.21 | 18.28 | 8.50 | 0.24 | 0.15 |
| Sample C | 0.065 | 0.59 | 1.41 | 0.029 | 0.010 | 0.09 | 18.30 | 8.81 | 0.19 | 0.10 |
| Sample D | 0.070 | 0.71 | 2.18 | 0.028 | 0.011 | 0.15 | 18.31 | 10.01 | 0.32 | 0.20 |
| Sample E | 0.073 | 0.62 | 1.50 | 0.027 | 0.003 | 0.03 | 18.38 | 8.61 | 0.03 | 0.211 |
| SUS 316 | 0.055 | 0.62 | 1.50 | 0.026 | 0.010 | 0.04 | 16.23 | 12.60 | 2.05 | 0.041 |

TABLE 2

| | Wire Diameter Used | | | | | |
|---|---|---|---|---|---|---|
| | Wire Diameter (mm) | | | | | |
| Sample | 0.3 ϕ | 0.6 ϕ | 0.7 ϕ | 0.9 ϕ | 1.0 ϕ | 2.0 ϕ |
| SUS 304 | ○ | ○ | | | ○ | ○ |
| A | ○ | ○ | | | ○ | ○ |
| B | | | | | ○ | ○ |
| C | | | | | | ○ |
| D | | | | | | ○ |
| E | ○ | ○ | | | ○ | |
| SUS 316 | ○ | | ○ | ○ | | ○ |

TABLE 3

| | Temperature of Last Die | |
|---|---|---|
| | Inlet | Outlet |
| SUS 304 | 32° C. | 120° C. |
| Sample B | 155° C. | 280° C. |
| SUS 316 | 30° C. | 115° C. |

FIG. 1 shows graphically the relation of the wire diameter after drawn and the tensile strength, in which the curves are plotted by ○ for Sample A, Δ for Sample B, □ for Sample C, ▽ for Sample D, ⭘ for Sample E, ● for SUS 304 (comparison) and x for SUS 316 (comparison). Referring to FIG. 1, the shaded portion is a zone defined by SUS 304 WPB Standard (JIS G 4314, Stainless Steel Spring Wire), in which there are Samples A, B, D and E. This is to say, these samples have an at least 10% higher strength than SUS 316.

In Table 4 the shear modulus important for a spring is shown as to Samples A, B and E according to the present invention and SUS 304 and SUS 316 of the prior art.

TABLE 4

| | Shear Modulus (wire diameter 2.0 mmϕ, torsional pendulum method) |
|---|---|
| Sample | Shear Modulus (Kg/mm$^2$) |
| SUS 304 | 7100 |
| Sample A | 7180 |
| Sample B | 7120 |
| Sample E | 7150 |
| SUS 316 | 7100 |

As can be seen from this table, Samples A, B and E can favourably be compared with SUS 304 and SUS 316 in shear modulus.

TABLE 5

| Dimension of Spring | |
|---|---|
| Wire Diameter | 2.0 mmϕ |
| Coil Mean Diameter | 18.5 mmϕ |
| Total Windings | 6.5 |
| Effective Windings | 4.5 |
| Winding Direction | Right |

TABLE 5-continued

| Dimension of Spring | |
|---|---|
| Free Length | 47.0 ± 0.3 mm |

Figure 2:
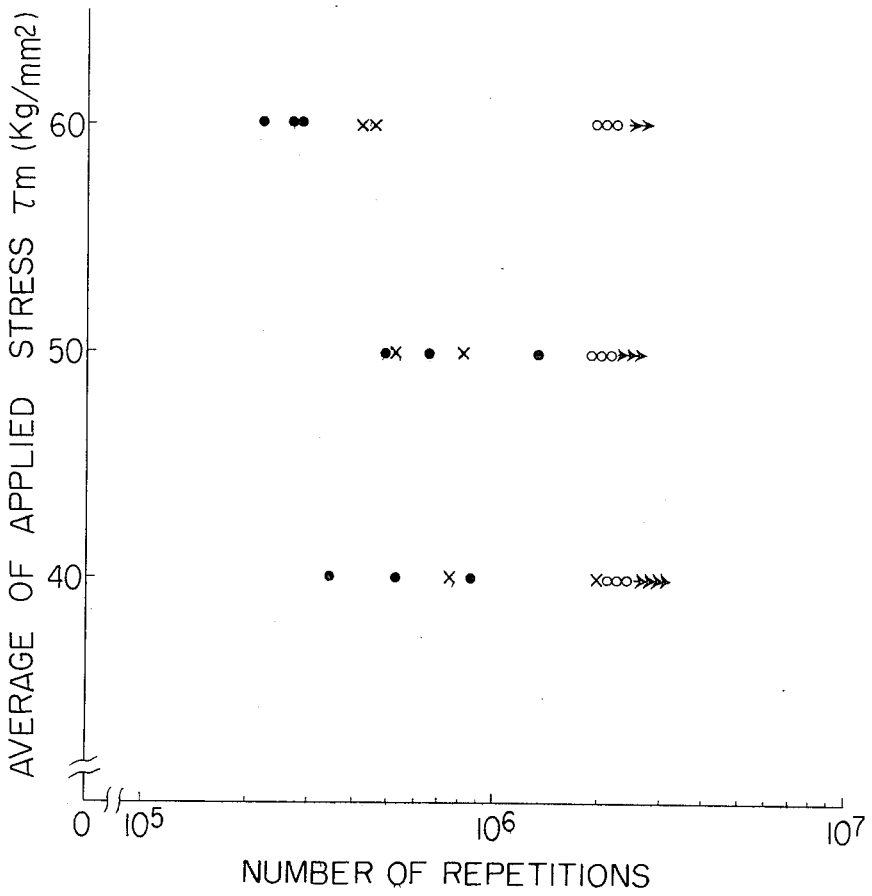
FIG. 2 and FIG. 3 show graphically the results of fatigue tests as to the stainless steels of the present invention and the prior art.

The wires were worked into springs each having the dimension shown in Table 5 under a condition of a low temperature annealing at 380° C. for 20 minutes and subjected to a spring fatigue test with a stress amplitude of ±20 Kg/cm$^2$. The results are shown in FIG. 2, in which Mark (○) shows the case of Sample A, Mark (●) shows the case of SUS 304 and Mark (x) shows the case of SUS 316. In the case of Mark (●) and Mark (x), the samples are broken but one, while in the case of Mark (○) according to the present invention, the sample is not broken and is resistant to a further fatigue test as represented by arrow (→). As apparent from these results, the fatigue property of Sample A is more improved as compared with SUS 304 and SUS 316.

Figure 3:
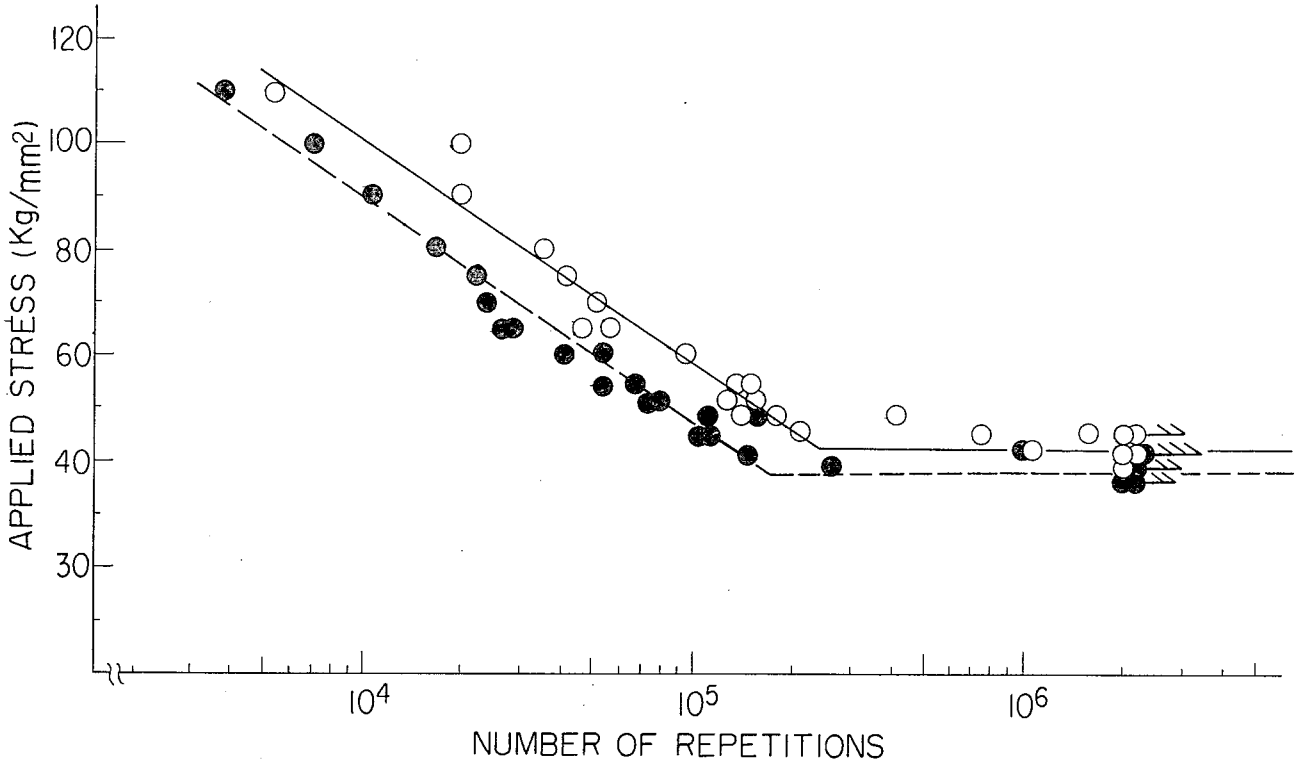

On the other hand, the wires, subjected to the low temperature annealing as set forth above, were further subjected to the Hanter Rotary Bending Fatigue test, thus obtaining results shown in FIG. 3. In FIG. 3 showing the relation of the number of repetitions and the amplitude of applied stress, Mark (○) shows the case of Sample E and Mark (●) shows the case of SUS 304. As can be seen from this graph, Sample E according to the present invention is superior to SUS 304 of the prior art in fatigue property.

Concerning the corrosion resistance, the pitting potential and maximum current density in active state (potential: about −0.2 to −0.3 V vs SCE) were sought from polarization measurement. Pitting is hard to occur with the increase of the potential and chemical resistance is increased with the decrease of the current density. The results are shown in Table 6:

TABLE 6

| | Pitting Potential and Maximum Current Density in Active State (in 5% $H_2SO_4$ + 3% NaCl, 35° C. wire diameter 2mm ϕ) | |
|---|---|---|
| Sample | Pitting Potential (V vs SCE) | Maximum Current Density in Active State (mA/cm$^2$) |
| SUS 304 | 0.04 | 2.45 |
| | 0.13 | 3.53 |
| | 0.14 | 3.57 |
| Sample A | 0.42 | 1.93 |
| | 0.31 | 1.90 |
| | 0.33 | 2.15 |
| Sample B | 0.35 | 1.98 |
| Sample E | 0.31 | 3.00 |
| SUS 316 | 0.53 | 3.73 |
| | 0.50 | 1.85 |

As evident from this table, Samples A, B and E are much superior to SUS 304.

It will clearly be understood from the results of a salt water spraying test as shown in Table 7 that Sample A according to the present invention is more excellent in corrosion resistance as compared with the prior art samples:

TABLE 7

| Sample | Salt Water Spraying Test (5% NaCl solution, Test Period 2 months) Surface State after Test |
|---|---|
| SUS 304 | one of three samples: corrosed at end thereof |
| Sample A | three samples: no corrosion |
| SUS 316 | three samples: no corrosion |

Figure 4:
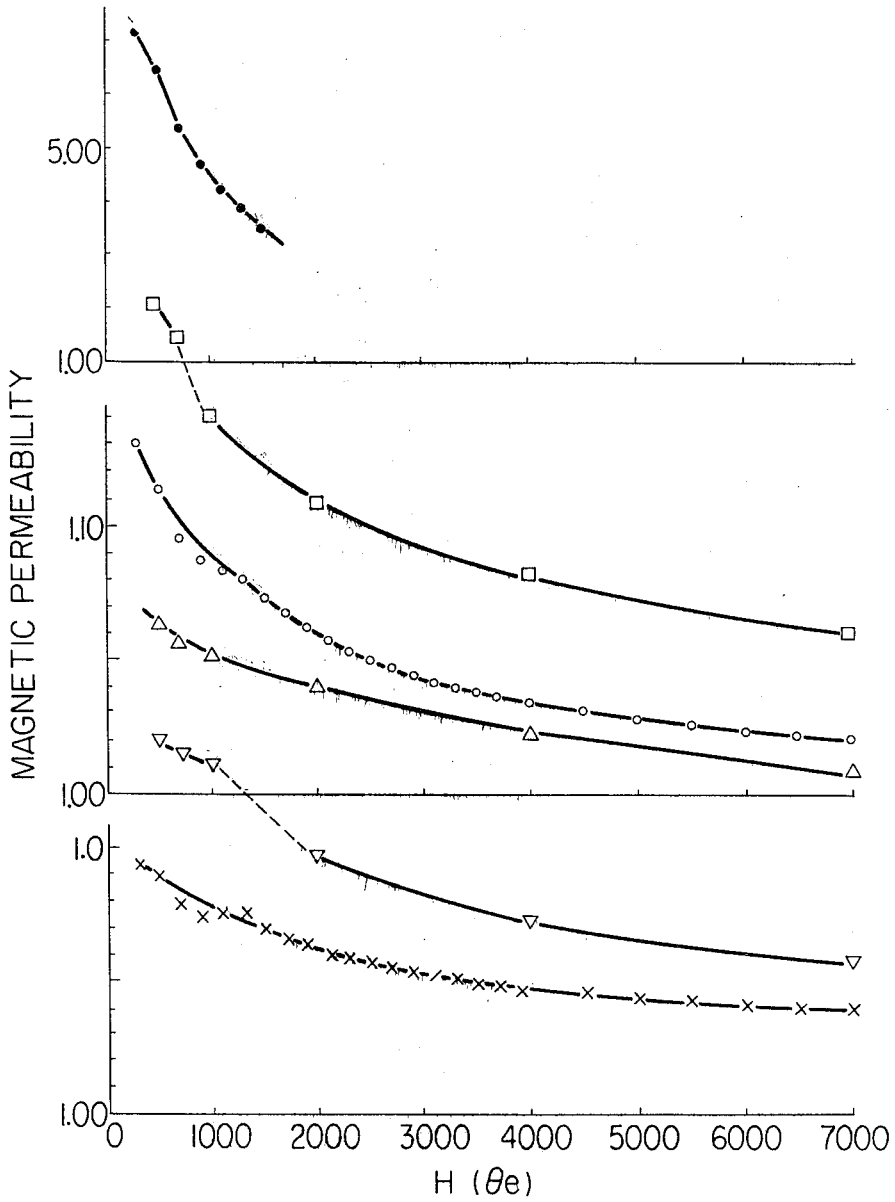
FIG. 4, FIG. 5 and FIG. 6 show graphically the magnetic permeability as to the stainless steels of the present invention and the prior art.
Figure 5:
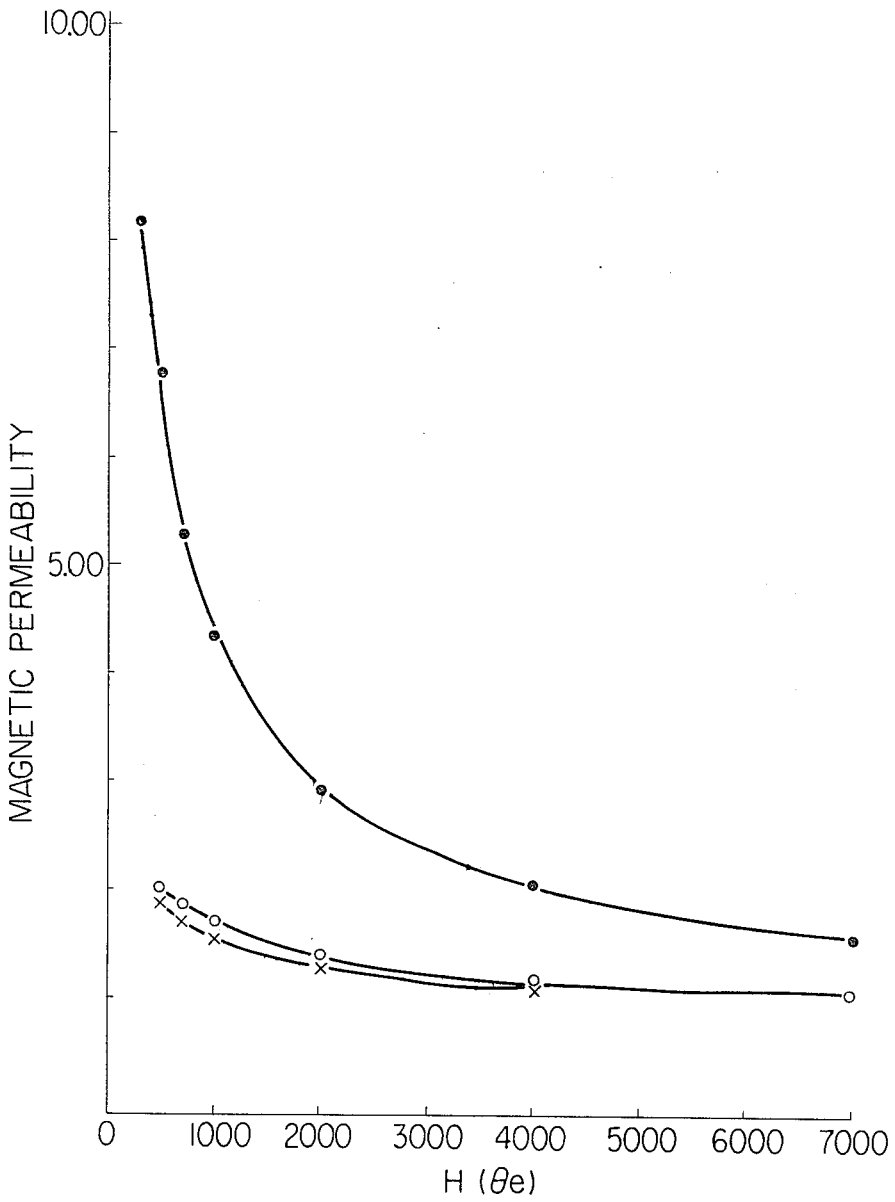

Then, the magnetic permeability was measured by means of Shimazu Magnetic Balance MB-b 11. In FIG. 4 there are shown results when using a wire of 2.0 mm $\phi$ in diameter and in FIG. 5 there are shown results when using a wire of 0.6 mm $\phi$ in diameter (SUS 304, Sample A) and a wire of 0.7 mm $\phi$ in diameter (SUS 316). In FIG. 4 and FIG. 5, the definitions of Marks are similar to those of FIG. 1. The measurement was impossible at a magnetic field of 300 oersteds or less depending on the measurment device. Samples of the present invention shows a magnetic permeability much lower than that of SUS 304 and considerably near that of SUS 316, and can favourably be used as a non-magnetic steel.

The results of FIG. 4 using a wire of 2.0 mm $\phi$ in diameter will now be discussed. In the case of SUS 304 for comparison, the austenite is unstable so that the strain-induced martensite is caused by drawing and the magnetic permeability is large. In the case of Sample A, 0.15% of nitrogen is added and the quantity of martensite is thus decreased, resulting in a markedly decreased magnetic permeability. Sample B has the same composition as Sample A, but has a lower magnetic permeability than Sample A since the formation of martensite is further suppressed by carrying out warm drawing. In Sample C, the quantity of nitrogen added is 0.10% being less than in Sample A and its effect is not so much as that of Sample A, but as compared with SUS 304, the magnetic permeability is considerably lower. In the case of Sample D, austenite-stabilizing elements such as Mn, Ni and N are added in such large amounts that the magnetism is the lowest of Samples, which is considerably close to that of SUS 316. SUS 316 for comparison has a large effect of nickel as an austenite-stabilizing element and thus a lowest magnetic permeability. Referring to FIg. 5, it will clearly be understood that in the case of narrower wires of 0.6 mm $\phi$ and 0.7 mm $\phi$ in diameter, Sample A has substantially the same property as SUS 316.

Figure 6:
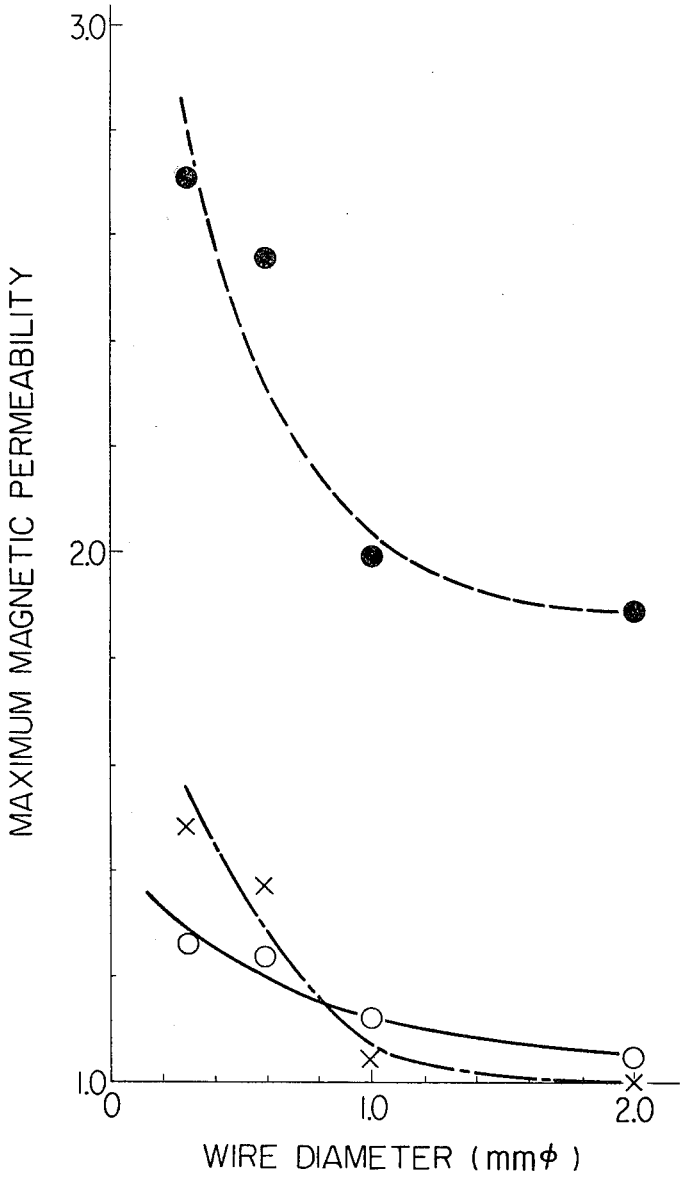

In addition, as to Sample E, SUS 304 and SUS 316, the maximum magnetic permeability was measured from the hysteresis curve by a vibrating magnetometer thus obtaining results shown in FIG. 6. It is apparent from the result of FIG. 6 that Sample E has substantially the same property as SUS 316.

As to Sample E of the present invention, SUS 304 and SUS 316 for comparison, the quantity of the stain-induced martensite was measured by X-ray diffraction to obtain results tabulated below:

TABLE 8

| Sample | (% by weight) Wire Diameter 0.3 mm $\phi$ | 0.6 mm $\phi$ | 1.0 mm $\phi$ | 2.0 mm $\phi$ |
|---|---|---|---|---|
| SUS 304 | 50% | 45% | 35% | 15% |
| Sample E | less than 3% | less than 3% | 0 | 0 |
| SUS 316 | less than 3% | less than 3% | 0 | 0 |

What is claimed is:

1. A high strength non-magnetic stainless steel for a spring, which consists essentially of 0.01 to 0.20% of carbon, 0.50 to 3.0% of manganese, 0.001 to 0.045% of phosphorous, 0.001 to 0.030% of sulfur, 0.10 to 1.00% of silicon, up to 2% of molybdenum, up to 1% of copper, 18.00 to 20.00% of chromium, 8.00 to 12.00% of nickel, 0.08 to 0.25% of nitrogen and the balance iron, and which is produced by subjecting the composition to a heat treatment and a cold or warm working treatment to obtain a strength sufficient for use as a spring.

2. A high strength non-magnetic stainless steel as claimed in claim 1 wherein 0.2% of carbon is present.

* * * * *